US006162513A

United States Patent [19]

Koh et al.

[11] Patent Number: 6,162,513

[45] **Date of Patent: *Dec. 19, 2000**

[54] METHOD FOR MODIFYING METAL SURFACE

[75] Inventors: Seok Keun Koh; Hyung Jin Jung; Won Kook Choi; Byung Ha Kang, all of Seoul, Rep. of Korea

[73] Assignee: Korea Institute of Science and Technology, Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/806,675

[22] Filed: Feb. 26, 1997

[30] Foreign Application Priority Data

Apr. 19, 1996 [KR] Rep. of Korea ..... 96/11995

[51] Int. Cl.[7] ..... C23C 8/36; C23C 8/02; B05D 3/06

[52] U.S. Cl. ..... 427/533; 427/539; 427/531; 427/562; 148/239; 148/241

[58] Field of Search ..... 427/531, 533, 427/534, 535, 539, 569, 576, 562, 564; 148/239, 241

[56] References Cited

U.S. PATENT DOCUMENTS

| | | | |
|---|---|---|---|
| 3,411,938 | 11/1968 | Storck et al. | 427/534 |
| 4,022,925 | 5/1977 | Reuter et al. | 427/533 |
| 4,357,182 | 11/1982 | Leveque | 427/533 |
| 4,452,679 | 6/1984 | Dunn et al. | 427/562 |
| 4,474,827 | 10/1984 | Ferralli | 427/533 |
| 4,500,564 | 2/1985 | Enomoto | 427/533 |
| 4,622,237 | 11/1986 | Lori | 427/533 |
| 4,780,176 | 10/1988 | Sudarshan et al. | 427/534 |
| 4,988,536 | 1/1991 | Van Dongen et al. | 427/533 |
| 5,302,422 | 4/1994 | Nowak et al. | 427/533 |
| 5,418,017 | 5/1995 | Ohmi | 427/533 |
| 5,445,682 | 8/1995 | Hasegawa et al. | 148/241 |

*Primary Examiner*—Marianne Padgett
*Attorney, Agent, or Firm*—Oblon, Spivak, McClelland, Maier & Neustadt, P.C.

[57] ABSTRACT

A process for modifying a metal surface by irradiating energized ion particles onto a metal surface while blowing a reactive gas directly on the metal surface under a vacuum condition. The process can achieve the effect of decreasing the wetting angle of the polymer or metal surface and enhancing the strength and the surface energy of the metal.

20 Claims, 10 Drawing Sheets

METHOD FOR MODIFYING METAL SURFACE

BACKGROUND OF THE INVENTION

1. Field of the Invention

The present invention relates to a method for modifying a metal surface which is performed by irradiating energized ion particles onto the surface of a metal under a vacuum condition.

2. Description of the Prior Art

When the surface of a polymer is modified by using an ion beam, an action between the polymers and the energized ion beam causes polymeric chains comprising the polymer to be cleaved by the ion beam and the cleaved chains are combined with one another, which is referred to as a crosslink phenomenon. When an ion beam or hundreds of KeV with a high energy is incident to a polymer, most couplings of chains are cleaved, which is referred to as a carbonization. When the ion beam is irradiated, if a reactive gas is simultaneously introduced such as oxygen or nitrogen on the surface where unstable chains the couplings of which are cleaved exist, a new polymer is formed due to a chemical reaction between the cleaved unstable chains and the reactive gases.

When an energized ion particle is irradiated onto the surface of an oxide to modify the surface characteristic, oxygen included in the oxide existing on the surface is eliminated and the element of an atmospheric gas is combined instead, as an attempt to increase a desired bond or an strength.

As to kinds of bondings in a material to be modified, a covalent bond is formed in the case of a polymer, and a mixed type of a covalent bond and an ionic bond in the case of an oxide. In the case of a polymer or an oxide, a new covalent bond or an ionic bond is formed on the surface thereby to form a desired bonding and change the property of the surface.

When comparing the surface modification of the polymer or oxide, it can be seen that the surface property can be modified by forming a new ionic bond or a covalent bond on the surface of the material composed by a metal bonding by free electron. The generation of the new ionic bond or the covalent bond formed on the surface of the metal can increase Van der Waals bonding with another material. Therefore, a strong adhesion to another material can be achieved and a hydrophilic property can be enhanced.

SUMMARY OF THE INVENTION

An object of the present invention is to provide a process for modifying a polymer or metal surface by irradiating energized ion particles onto a metal surface, while blowing a reactive gas directly onto the metal surface under a vacuum condition.

Another object of the present invention is to provide a method for modifying a metal surface which is capable of increasing the strength and surface energy of the metal.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The method for modifying the surface of a metal according to the present invention will now be described with reference to the accompanying drawings.

Since a metal consists of a metal atoms bonded by free electrons and is conductive, when a particle with an acceleration energy is irradiated onto the surface of the metal, power is directly connected to the conductive body and therefore when a particle with energy is irradiated onto the surface of the metal, ions can be preferably formed under an environment that a voltage of an electric potential is grounded.

Figure 2A:
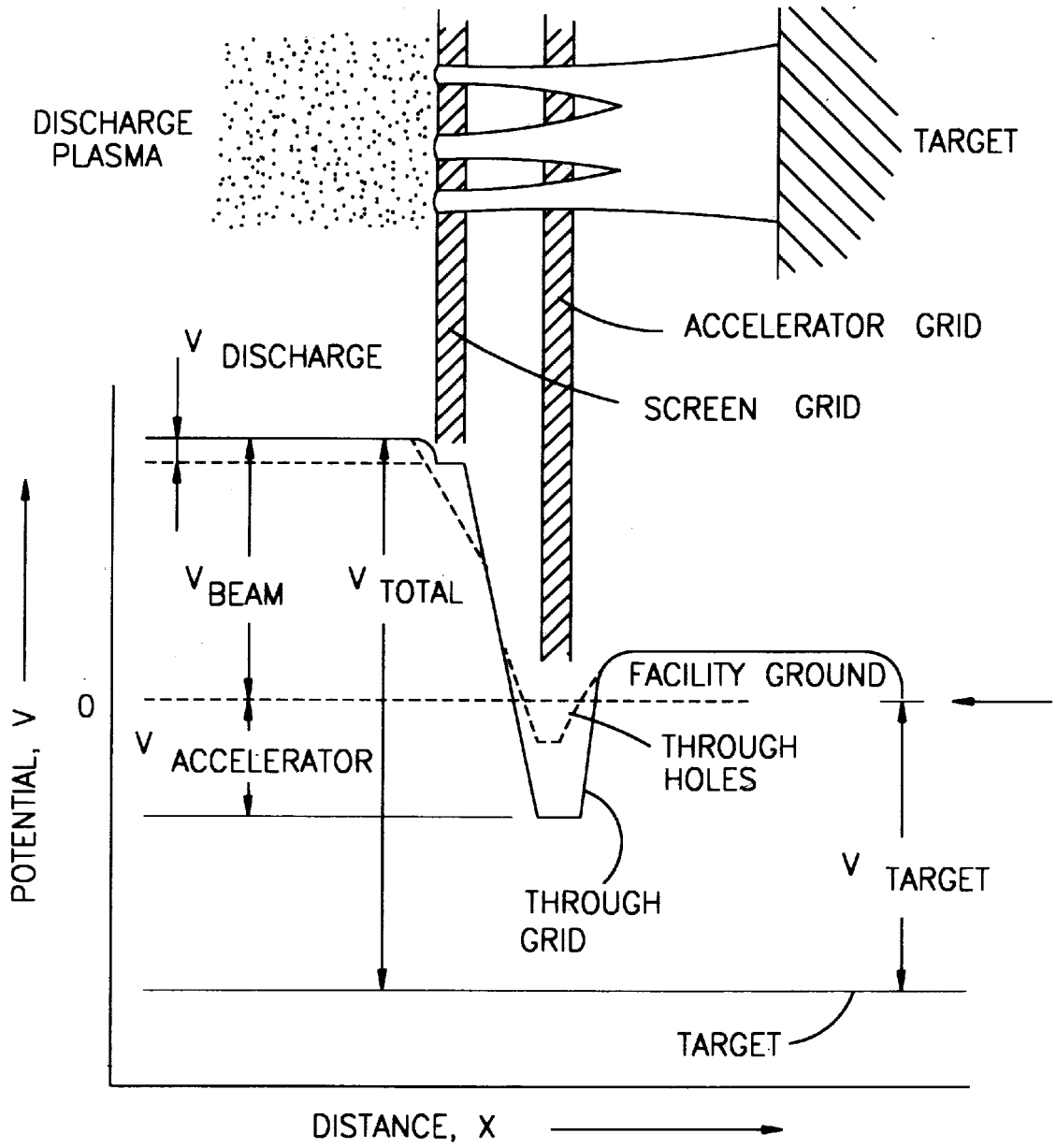
FIG. 2 is a view showing a power source device in the apparatus employed in the method for modifying the surface of a metal according to the present invention.
Figure 2B:
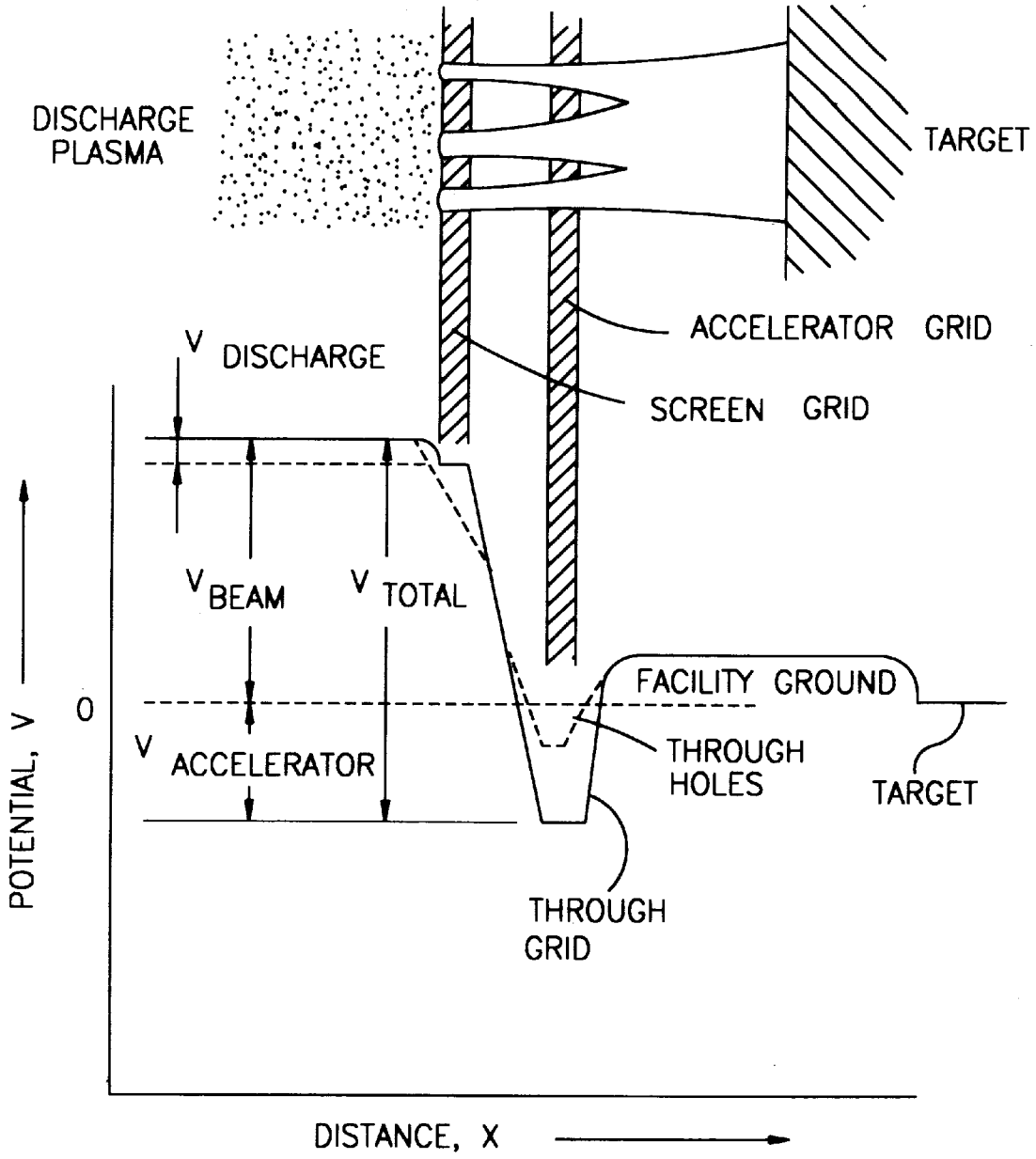

As shown in FIG. 2, a negative current is applied to a conductive body, thereby to uniformly irradiate ions onto the surface of a material having a three-dimensional configuration as well as a material having a two-dimensional structure.

Description of the method for modifying the surface of the metal according to the present invention will now be given in more detail.

1. To make the surface of the metal clean, the surface of the metal is washed with a weak acid, soap and water,an organic solvent or the like. If required, the surface of the metal is dried for three to four hours in a drying oven at a temperature of 100° C. so as to eliminate material absorbed thereon. The purpose of the above-mentioned washing process is to eliminate impurities existing on the surface and can be replaced with the detachment of pollutants in a high vacuum or the treatment by a process for an energized ion beam.

2. The cleansed surface of the metal is placed in a vacuum chamber, which is maintained to be at a pressure $10^{-4}$–$10^{-6}$ torr by a vacuum gauge.

3. A reactive gas is introduced around the metal surface by varying the amount thereof.

4. By varying the energy in the range of the appropriate amount of energy, for example, 0.5 keV–1.5 keV, a desired amount of positive ion beams with different energies are irradiated with a gas ion gun. Here, the vacuum condition of the vacuum chamber must be maintained to be at a pressure of $10^{-4}$–$4\times10^{-4}$ torr.

According to the method for modifying the metal surface of the present invention, the irradiating amount of energized ion particles is $10^{14}$–$5\times10^{17}$ ions/cm$^2$, and the energy of the ion particles is 0.5 keV–2.5 keV, preferably about 1 keV. In particular, the energy and fluency of ion particles is varied depending on the type of metal. If the irradiating amount of energized ion particles exceeds a certain range, an desirable damage to the metal surface, such as sputtering effects, in which portions of the metal surface are separated, undesirable cleavage of polymer chains, and other undesired effects may occur.

The ion beam can be obtained by introducing particles including atoms, molecules and gases into an ion gun to be ionized. As for the ion gun, Cold Hollowed Cathode, Kaufman type, high frequency type, etc. can be used. Any particles which can be ionized, such as argon, oxygen, krypton, air a mixed gas of oxygen and nitrogen, or any mixed gas thereof can be used. By applying voltage to the ion beam, the ion particles obtain energy, as described above. By adjusting the current of the ion beam, the irradiating amount of ion particles can be controlled. The current of the ion beam can be controlled according the discharge current, discharge voltage, acceleration potential, or the like.

When the ion particles are introduced, the pressure in the vacuum chamber increases from the original vacuum condition of $10^{-5}$–$10^{-6}$ torr to $10^{-3}$ to $5\times10^{-4}$ torr, and is maintained thereafter. The above described vacuum condition is appropriately set for generating energized particles. In general, in the case of a low vacuum, if the pressure inside the vacuum chamber becomes too high, arc discharge occurs because of the high voltage (0.5–2.5 keV) applied to the ion beams, and ion particles from the ion beams collide with other residual gas particles to hinder the gas from proceeding, before they reach the metal surface at a certain distance, whereby the generated ions cannot effectively reach the metal surface. In this case, the distance from the ion gun to the metal surface must be decreased to ensure that the ion particles reach the metal surface.

According to another embodiment of the present invention, non-layer-depositing reactive gas or gases is/are suitable gases which can prepare hydrophilic functional groups, for example, oxygen, hydrogen, nitrogen, carbon monoxide, ammonia, and any mixed gas thereof, etc. The introduced amount of these reactive gas or gases is limited in the range of 1–20 ml/min, depending on pumping speed in order to maintain the proper pressure for plasma generation within the vacuum chamber and to allow a sufficient amount of reactive gas required for the formation of hydrophilic groups. For introducing the reactive gas or gases, it is advantageous that the reactive gas is blown directly onto the metal surface simultaneously with the process of irradiating energized particles onto the metal surface.

According to another embodiment of the present invention, when energized ion particles are irradiated onto the metal surface in an ion beam current density of 1–30 $\mu$A/cm$^2$, the irradiation distance is determined depending on the vacuum degree, and the distance is preferably 25 cm under degree of vacuum of more than $5\times10^{-3}$ torr, 25–55 cm under degree of vacuum of $5\times10^{-3}$–$1\times10^{-6}$ torr, and more than 55 cm under degree of vacuum of less than $10^{-6}$ torr. When the energized particles reach the metal surface to be modified, the required "mean free path" of the ion particles will vary depending on the degree of pressure in the vacuum. Thus, the distance defined above is achieved according to each range of vacuum degree. The irradiation distance can be properly adjusted because the energy of the ion particles is as low as 0.5–2.5 keV, as described above.

Figure 1:
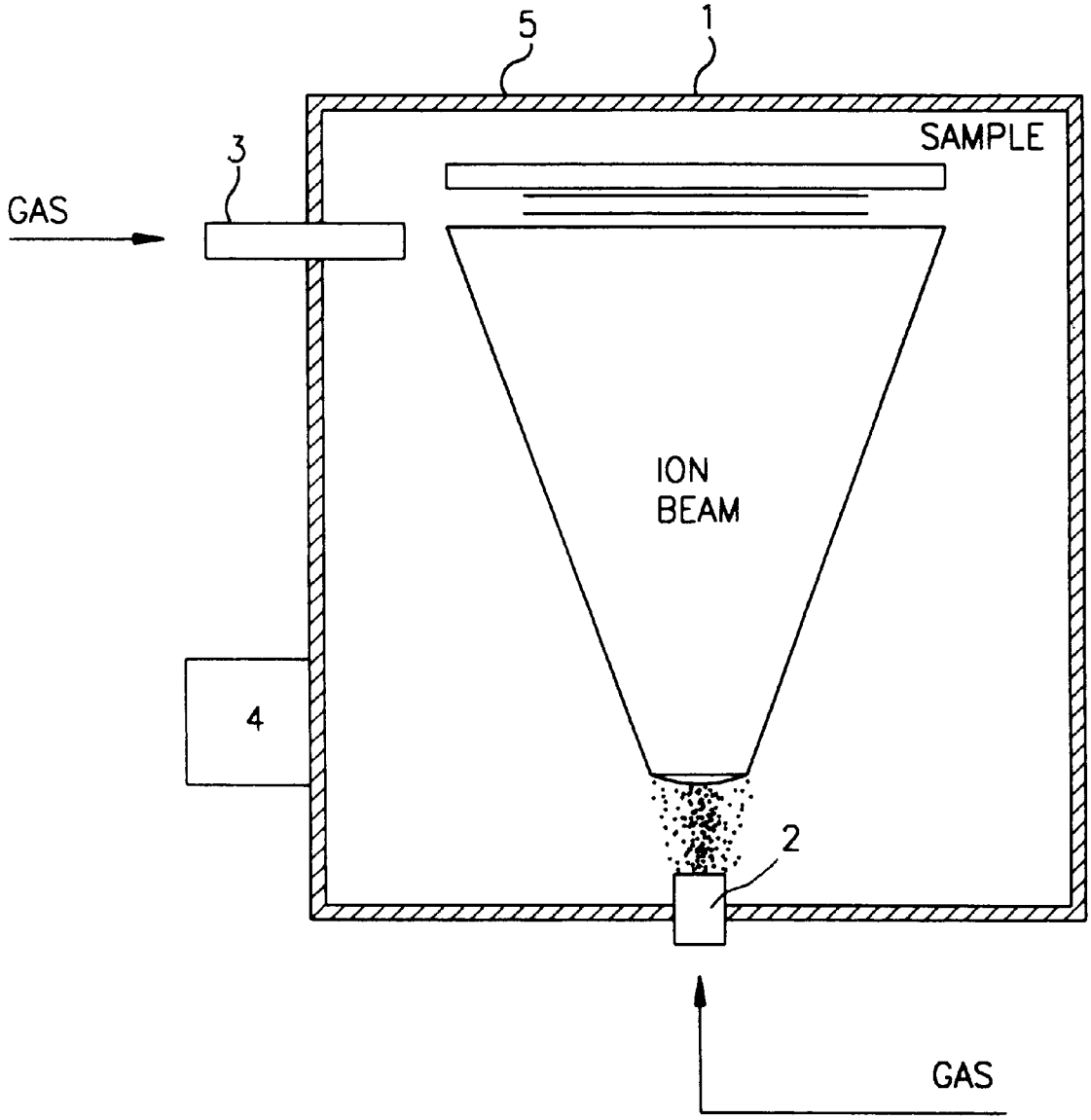
FIG. 1 is a schematic diagram of a surface treating apparatus employed in a method for modifying the surface of a metal according to the present invention.

As shown in FIG. 1, the apparatus adopted in the method for modifying the metal surface according to the present invention includes an ion gun (2) connected to an electric power source (not shown), a sample fixing holder (5) positioned toward the ion gun (1) for placing a sample, a reactive gas introducer (3) provided with a controlling unit for introducing an appropriate amount of gas in order to generate reactive functional groups on the sample surface, and a vacuum chamber (1) enclosing the above elements. In the vacuum chamber (1) is provided a vacuum gauge (4) for maintaining a constant vacuum condition in the vacuum chamber (1).

In the apparatus capable of being adopted in the present invention, as shown in FIG. 2, so as to apply higher voltage to the electric power source, a bias voltage is directed to being applied to a target. By applying a negative charge to the sample, ions can be uniformly irradiated onto the surface of materials having a three-dimensional configuration as well as material having a two-dimensional structure, resulting in modifying the uneven surfaces.

According to the method for modifying the surface of a metal of the present invention, while maintaining the material the surface of which is to be modified to have a '0' volts ground potential, ion particles taking on a positive voltage charge can be irradiated onto the surface of the material, and a negative voltage is applied to the material the surface of which is to be modified and ion particles taking on a positive voltage change can be irradiated onto the surface of the material.

According to the method of the present invention, the metal the surface of which is modified has a remarkably reduced wetting angle of water, and the reduction of the wetting angle of water is an important factor used as an indirect standard of measuring the adhesive strength with another material. As a result, since the metal the surface of which has been modified has an increased adhesive property to another material, the method can be applied when materials having different functions are coated on the surface of the metal, for example, in a decoration, a printing, a coating of hydrophilic organic material for anti-corrosion and the like.

Since the surface-modified metal according to the present invention has an improved adhesive strength to another metal, different kinds of metals can be deposited on the surfacemodified metal according to the present invention by a thermal deposition, which makes fabrication of new complex materials possible.

In another applied example, hydrophilic material can be coated on the metal. In this example, generally, a thin water film is formed on the surface of a heat exchanger by spreading a condensed waterdrop caused by a difference in the temperature of the heat exchanger to thereby increase a heat transfer coefficient of the film, resulting in increasing heat transfer in the heat exchanger.

By controlling the reaction condition of reactive gases, the property of the material surface can be varied from a hydrophilic one to a hydrophobic one or vice versa.

Hereafter, the process for modifying metal surfaces by using the present device is described in more detail referring to the examples. However, it is not intended to limit the scope of the present invention to these Examples.

EXAMPLES 1

Using the apparatus of FIG. 1, by controlling the discharge voltage of an ion beam in the discharge tube, the total amount of the ion beam irradiated on the surface of the aluminum test piece was varied up to $10^{14}$–$10^{17}$/cm$^2$. The energy of the ion particles was controlled in the range of about 0.5 keV–1.5 keV. Hydrogen and oxygen were used as reactive gases and the irradiating amount was controlled up to 0–6 sccm(ml/min) by using a ball type flowmeter. The vacuum degree was maintained to be at a pressure of $1\times10^{-5}$ torr–$5\times10^{-5}$ torr after placing a sample. The reactive gas was introduced while irradiating the energized ion, to reach a vacuum degree up to $1\times10^{-4}$ torr–$5\times10^{-4}$ torr. By controlling the reaction conditions, the property of the material surface could be varied from hydrophilic to hydrophobic or vice versa.

Figure 3:
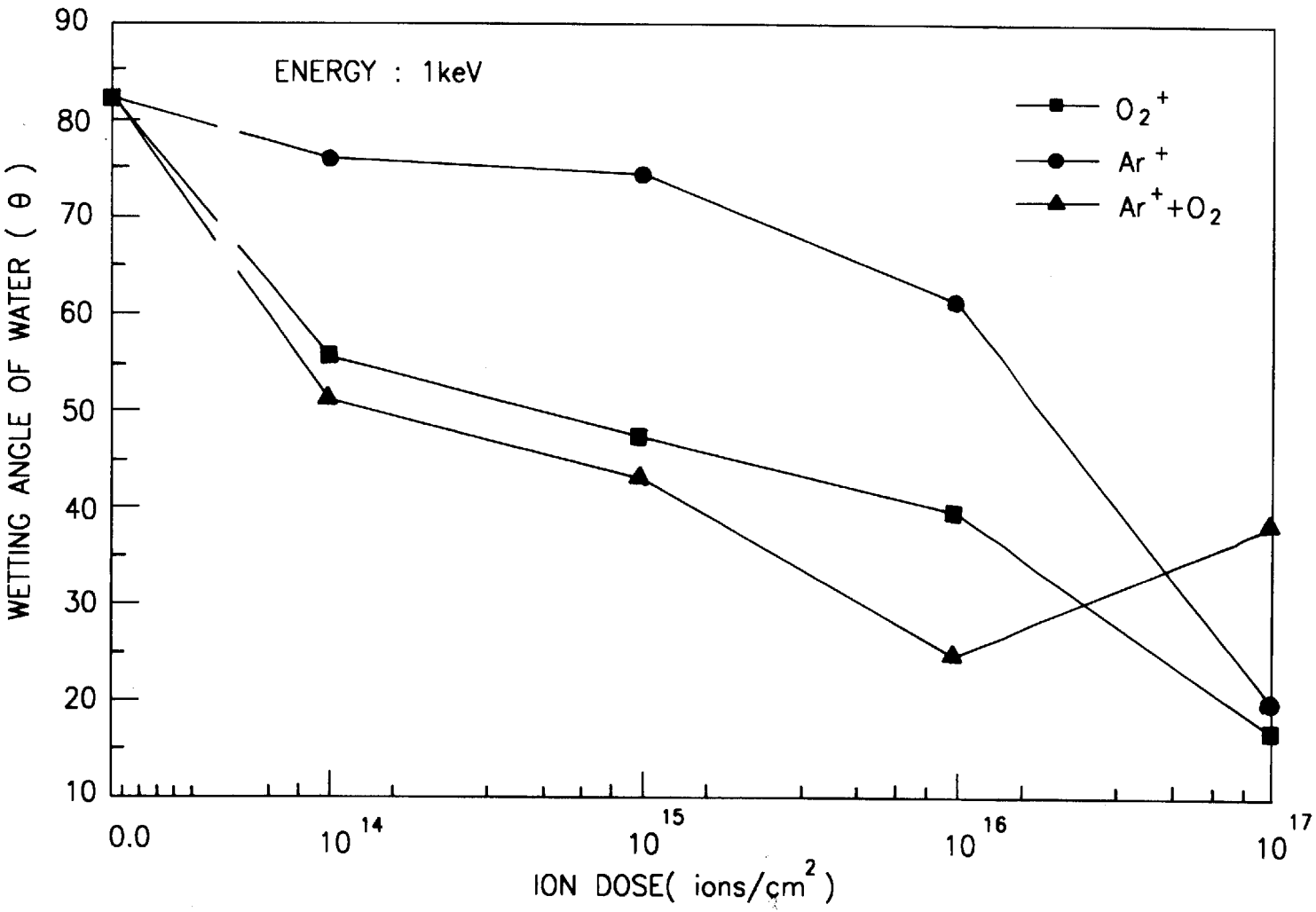
FIG. 3 is a graph showing the reduction in the wetting angle of water when the surface of aluminum is modified by different amounts of ion irradiation while irradiating with $O_2^+$, $Ar_+$, and $Ar_+$ and $O_2^+$.

As shown in FIG. 3, the energy of the ion particles was set to be 1 keV and the experiment was carried out by using different irradiating amounts of oxygen ions, argon ions, and argon and oxygen ions. As a result, as the amount of ion irradiation was increased, the wetting angle of water was decreased. According to the kinds of the irradiated particles, the degree and tendency of the reduction in the wetting angle of water was different to a small degree.

Figure 4:
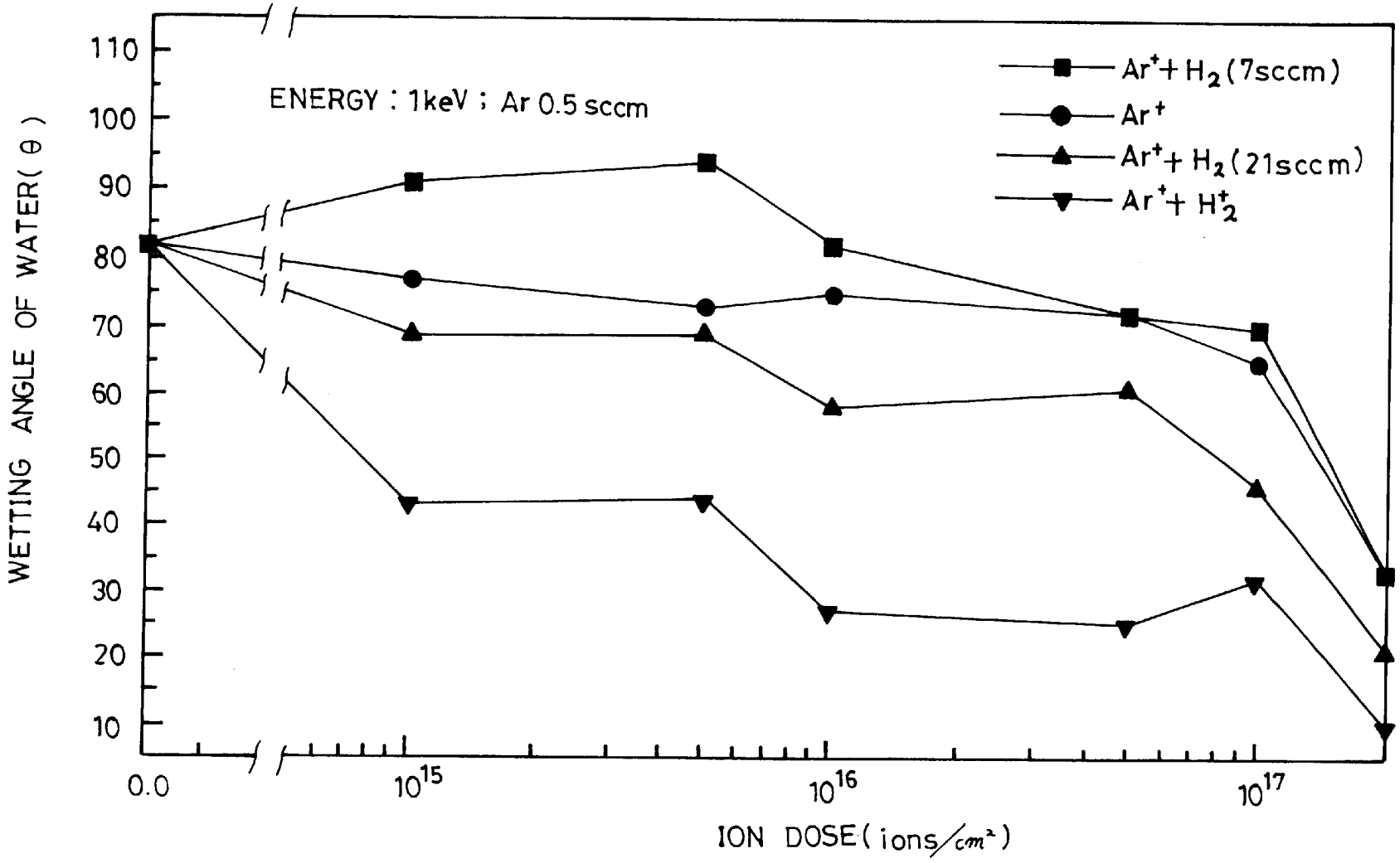
FIG. 4 is a graph showing the reduction in the wetting angle of water when the surface of aluminum is treated with different amounts of hydrogen introduction.

FIG. 4 is a graph showing the reduction in the wetting angle of water when the surface of aluminum was treated with different amounts of hydrogen introduction. The amount of hydrogen was measured by the flow of hydrogen gas displayed on a flowmeter and by converting the flow into the floatage.

Figure 5:
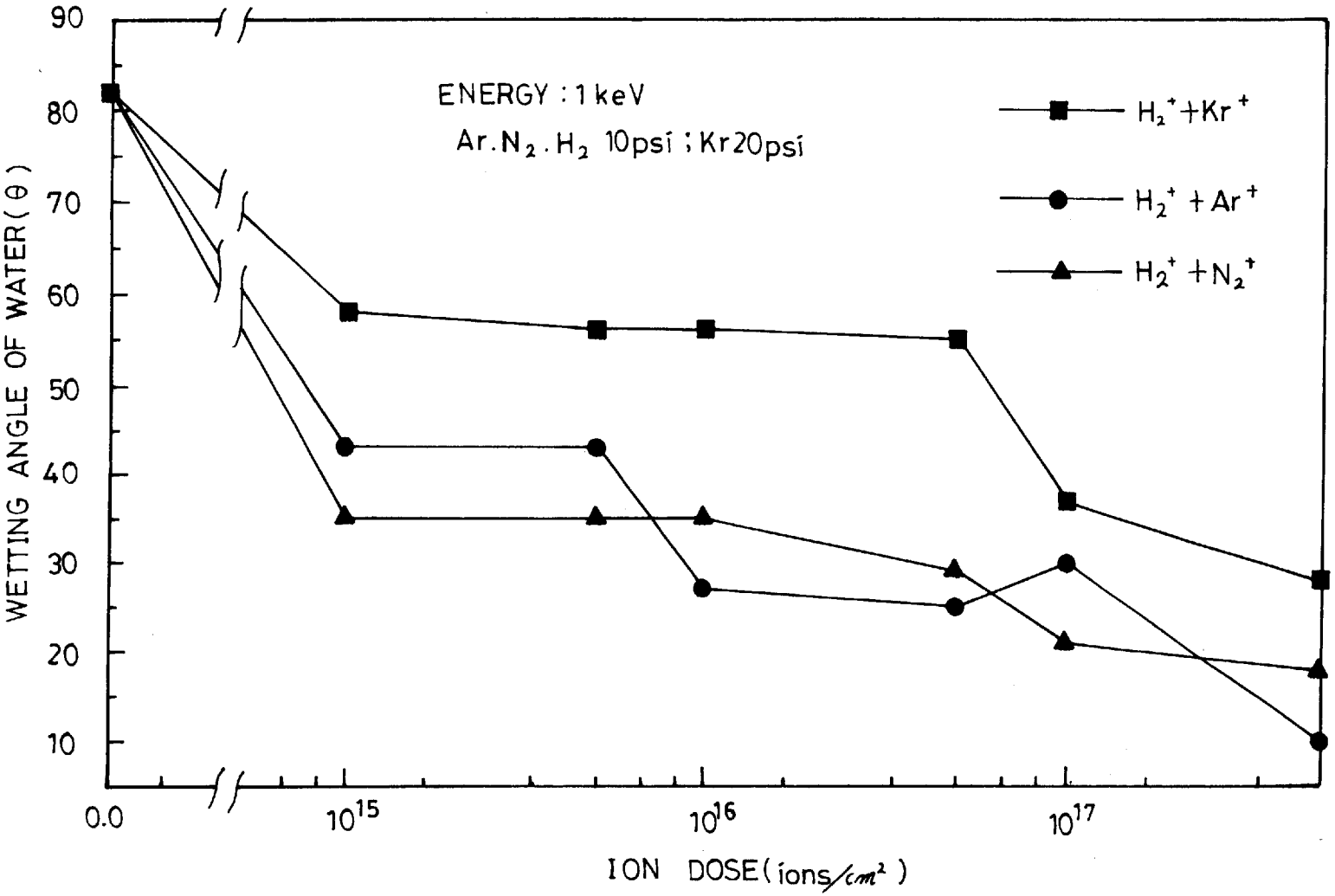
FIG. 5 is a graph showing the reduction in the wetting angle of water when the surface of aluminum is treated by using a mixtures of ionized gas.

FIG. 5 shows the reduction in the wetting angle of water when the ion beam was made of a gas mixingly composed of hydrogen, argon, nitrogen and krypton and the gas was irradiated onto the surface of the aluminum sample. When the mixed gas is ionized and irradiated, it can be seen that the wetting angle of water was remarkably reduced.

EXAMPLE 2

Figure 6:
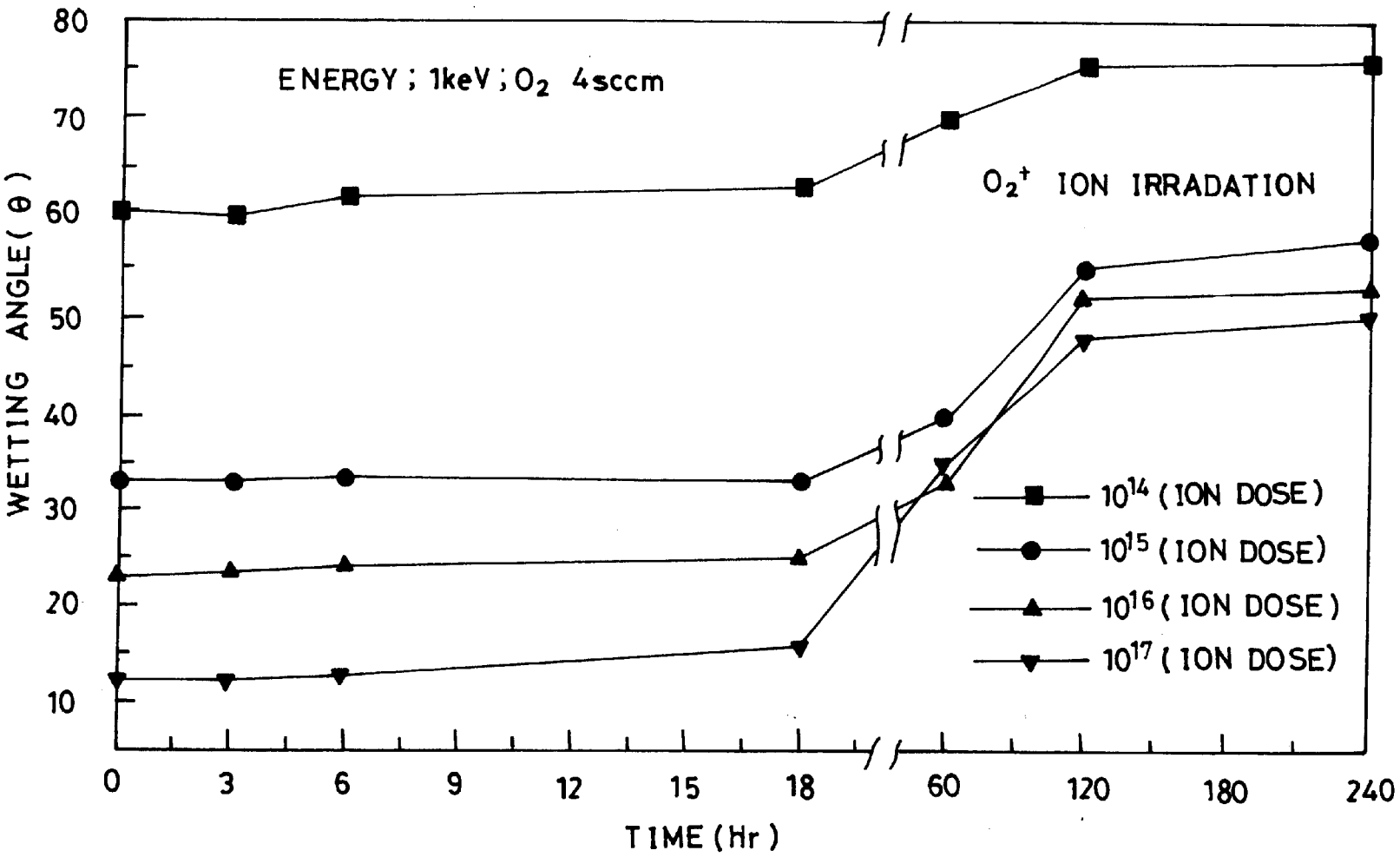
FIG. 6 is a graph showing the change in the wetting angle of water with respect to time after the aluminum is treated by an oxygen ion beam with different amounts of ion irradiation.

Gaseous $O_2$ was blown onto the aluminum test piece and the energy of the particles was set to be 1 keV using oxygen ions. By varying the amount of ion irradiation, the oxygen ions were irradiated on the surface of the aluminum. The samples of aluminum the surface of which was modified were exposed to the air and then the reduction in the wetting angle of water was measured in accordance with the lapse of time. As shown in FIG. 6, after three to five days passed, the wetting angle of water was considerably restored to an original value. The suspected reason is that the hydrophilic functional groups formed on the metal surfaces are dissolved by water and the surface is restored to its original condition.

Figure 7:
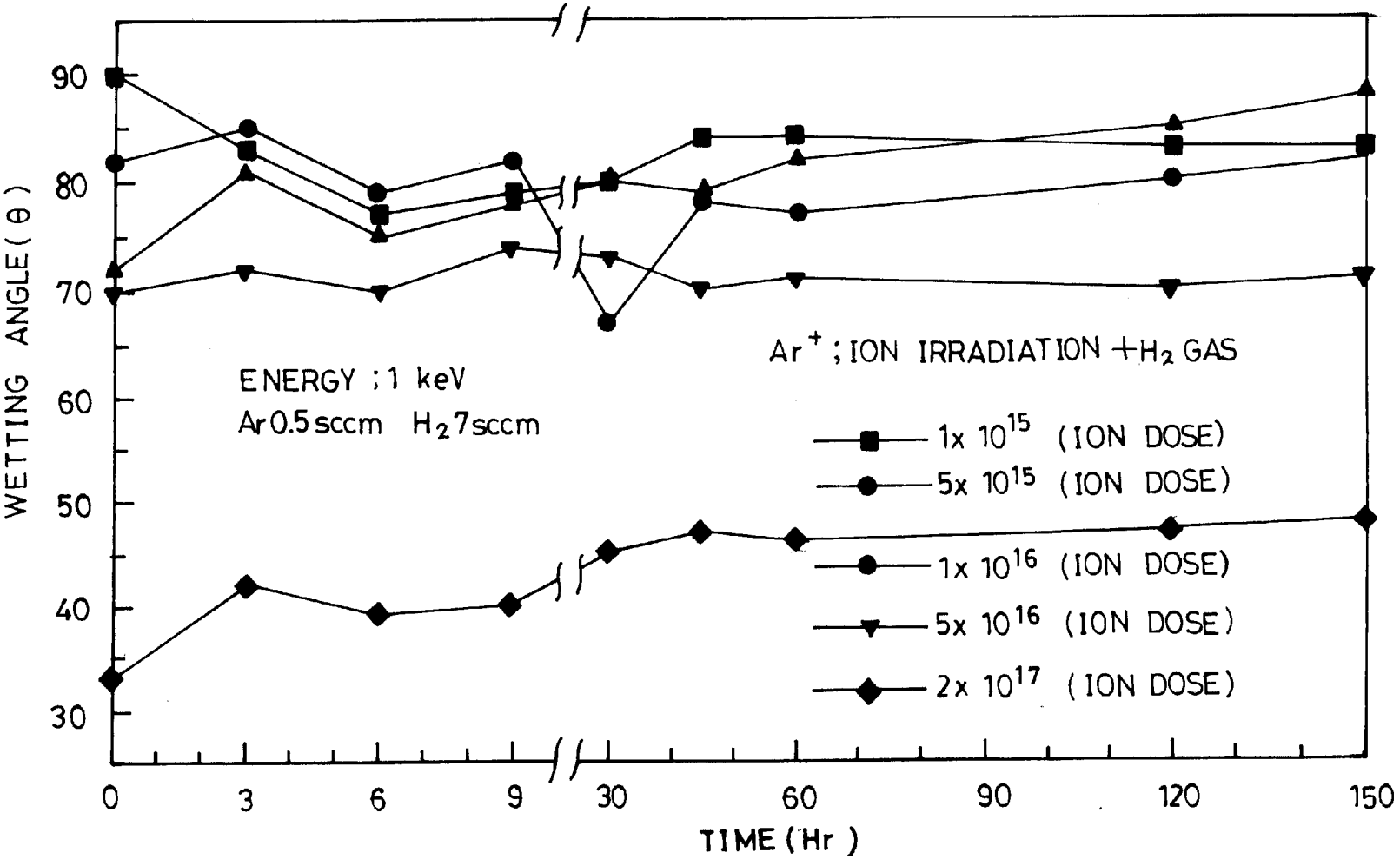
FIG. 7 is a graph showing the change in the wetting angle of water with respect to time after the aluminum is treated by an argon ion beam, providing hydrogen.

FIG. 7 is a graph showing the change in the wetting angle of water with respect to the lapse of a time after the aluminum is treated by an argon ion beam under various conditions under a hydrogen atmosphere. As a result, most of the samples were easily restored to their original condition but the degree of restoration was considerably delayed in the case of employing argon ions of $10^{17}$/cm$^2$ +$H_2$, thus the metal hydrophilic surface was stable.

Figure 8:
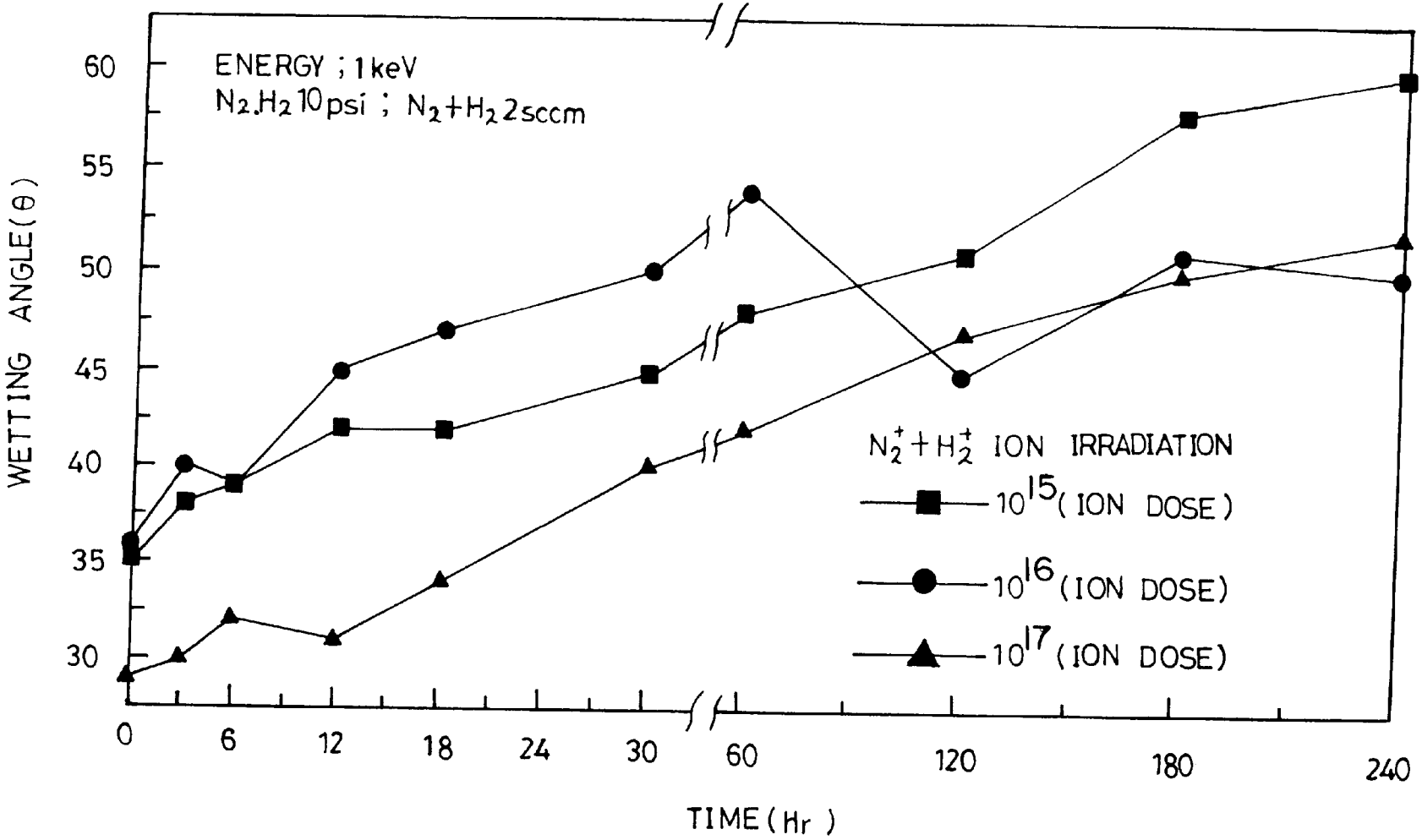
FIG. 8 is a graph showing the change in the wetting angle of water with respect to time after the aluminum is treated by nitrogen and hydrogen ion beams with different amounts of ion irradiation.

FIG. 8 is a graph showing the change in the wetting angle of water with respect to time after the aluminum is treated by nitrogen and hydrogen ion beams under various conditions. In this case, with the increase of time, the wetting angle of water was continuously increased.

Figure 9:
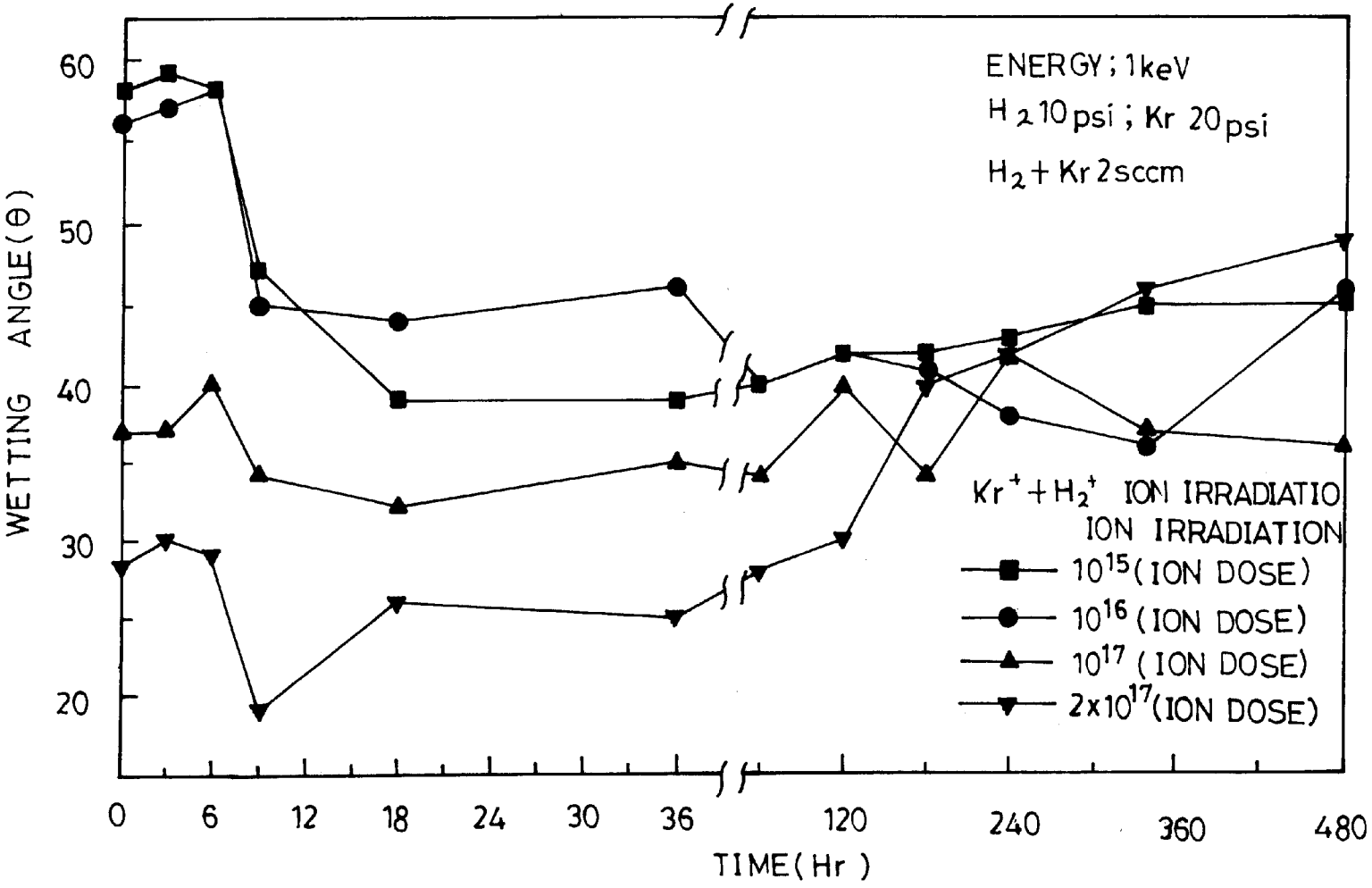
FIG. 9 is a graph showing the change in the wetting angle of water with respect to time after the aluminum is treated by krypton and hydrogen ion beams.

FIG. 9 is a graph showing the change in the wetting angle of water with respect to a time after the aluminum sample is treated by krypton and hydrogen ion beams.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A process of modifying a surface of a metal, comprising simultaneous steps of:

providing the metal surface in a vacuum chamber;

blowing under vacuum a non-layer-depositing reactive gas onto the metal surface at a flow rate of 1–20 ml/min such that said blown gas impinges on said metal surface before being scattered into the vacuum chamber;

biasing the metal surface to a negative potential; and irradiating energized ion particles of at least 0.5 keV onto the metal surface so as to form a stable hydrophilic metal surface.

2. The process of claim 1, wherein the step of blowing the gas comprises:

providing gas selected from the group of consisting of oxygen, nitrogen, hydrogen, ammonia, carbon monoxide and any mixtures thereof.

3. The process of claim 1, wherein the step of irradiating the energized ion particles comprises:

providing the ion particles selected from the group of consisting of ions of argon, oxygen, nitrogen, hydrogen, krypton, and any mixtures thereof.

4. The process of claim 1, wherein the step of irradiating the energized ion particles comprises:

energizing ion particles such that energy of the ion particles is 0.5 keV–2.5 keV.

5. The process of claim 1, wherein the step of irradiating the energized ion particles comprises:

providing the energized ion particles at an amount of $10^{14}$ to $5\times10^{17}$ ions/cm$^2$.

6. The process of claim 1, further comprising:

a step of adjusting a distance between the surface of the metal and an ion gun which irradiates the energized ion particles to be 25–55 cm under degree of vacuum of $5\times10^{-3}$–$1\times10^{-6}$ torr.

7. The process of claim 1, further comprising:

a step of adjusting a distance between the surface of the metal and an ion gun which irradiates the ion particles to be more than 55 cm under degree of vacuum of less than $10^{-6}$ torr.

8. The process of claim 1, further comprising:

a step of adjusting a distance between the surface of the metal and an ion gun which irradiates the ion particles to be less than 25 cm under degree of vacuum of more than $5\times10^{-3}$ torr.

9. The process of claim 1, wherein said simultaneous blowing, biasing, and irradiating steps form a metal surface containing hydrophillic groups.

10. The process of claim 1, wherein said simultaneous blowing, biasing, and irradiating steps occurs on a non-planar metal surface.

11. A process of modifying a surface of a metal, comprising simultaneous steps of:

providing the metal surface in a vacuum chamber;

blowing under vacuum a non-layer-depositing reactive gas onto the metal surface at a flow rate of 1–20 ml/min such that said blown gas impinges on said non-planar metal surface before being scattered into the vacuum chamber;

biasing said metal surface to a negative potential; and irradiating positively biased energized ion particles of at least 0.5 keV onto said biased metal surface so as to form a stable hydrophillic surface.

12. The process of claim 11, wherein the step of blowing the gas comprises:

providing gas selected from the group of consisting of oxygen, nitrogen, hydrogen, ammonia, carbon monoxide and any mixtures thereof.

13. The process of claim 11, wherein the step of irradiating the energized ion particle beam comprises:

providing the ion particles selected from the group of consisting of ions of argon, oxygen, nitrogen, hydrogen, krypton, and any mixtures thereof.

14. The process of claim 11, wherein the step of irradiating the energized ion particle beam comprises:

energizing the ion particles such that energy of the ion particles is 0.5 keV–2.5 keV.

15. The process of claim 11, wherein the step of irradiating the energized ion particle beam comprises:

providing the energized ion particles at an amount of $10^{14}$ to $5\times10^{17}$ ions/cm$^2$.

16. The process of claim 11, further comprising:

a step of adjusting a distance between the surface of the metal and an ion gun which irradiates the energized ion particles to be 25–55 cm under degree of vacuum of $5\times10^{-3}$–$1\times10^{-6}$ torr.

17. The process of claim 11, further comprising:

a step of adjusting a distance between the surface of the metal and an ion gun which irradiates the ion particles to be more than 55 cm under degree of vacuum of less than $10^{-6}$ torr.

18. The process of claim 11, further comprising:

a step of adjusting a distance between the surface of the metal and an ion gun which irradiates the ion particles to be less than 25 cm under degree of vacuum of more than $5\times10^{-3}$ torr.

19. The process of claim 11, wherein said simultaneous blowing, biasing, and irradiating steps form a metal surface containing hydrophillic groups.

20. The process of claim 11, wherein said simultaneous blowing, biasing, and irradiating steps occurs on a non-planar metal surface.

* * * * *